US007464554B2

(12) United States Patent
Cheung et al.

(10) Patent No.: US 7,464,554 B2
(45) Date of Patent: Dec. 16, 2008

(54) GAS TURBINE COMBUSTOR HEAT SHIELD PANEL OR EXHAUST PANEL INCLUDING A COOLING DEVICE

(75) Inventors: Albert K. Cheung, East Hampton, CT (US); Nikolaos Napoli, Jensen Beach, FL (US); Irving Segalman, Boynton Beach, FL (US)

(73) Assignee: United Technologies Corporation, Hartford, CT (US)

( * ) Notice: Subject to any disclaimer, the term of this patent is extended or adjusted under 35 U.S.C. 154(b) by 502 days.

(21) Appl. No.: 10/938,440

(22) Filed: Sep. 9, 2004

(65) Prior Publication Data

US 2006/0059916 A1 Mar. 23, 2006

(51) Int. Cl.
*F02C 1/00* (2006.01)
*F02G 3/00* (2006.01)

(52) U.S. Cl. ..... 60/754; 60/770

(58) Field of Classification Search ..... 60/752–760, 60/770; 416/97 A, 97 R; 415/115
See application file for complete search history.

(56) References Cited

U.S. PATENT DOCUMENTS 3,554,663 A * 1/1971 Helms ..... 416/90 R
3,584,972 A * 6/1971 Bratkovich et al. ..... 416/229 R
3,606,572 A * 9/1971 Schwedland ..... 416/90 R
3,619,082 A * 11/1971 Meginnis ..... 416/90 R
4,158,949 A 6/1979 Reider
4,195,476 A 4/1980 Wood
4,296,606 A * 10/1981 Reider ..... 60/754
4,302,940 A * 12/1981 Meginnis ..... 60/754
4,315,406 A * 2/1982 Bhangu et al. ..... 60/754
4,767,268 A * 8/1988 Auxier et al. ..... 416/97 R
5,223,320 A * 6/1993 Richardson ..... 428/137
5,403,159 A * 4/1995 Green et al. ..... 416/97 R
5,419,681 A * 5/1995 Lee ..... 416/97 R
5,435,139 A * 7/1995 Pidcock et al. ..... 60/757
5,598,697 A * 2/1997 Ambrogi et al. ..... 60/782
5,690,472 A * 11/1997 Lee ..... 416/97 R
5,758,503 A 6/1998 DuBell et al.
5,775,108 A * 7/1998 Ansart et al. ..... 60/752
5,782,294 A * 7/1998 Froemming et al. ..... 165/168
5,941,076 A * 8/1999 Sandelis ..... 60/752
5,967,752 A * 10/1999 Lee et al. ..... 416/97 R
5,997,251 A * 12/1999 Lee ..... 416/97 R
6,029,455 A * 2/2000 Sandelis ..... 60/752
6,089,822 A * 7/2000 Fukuno ..... 415/115
6,145,319 A * 11/2000 Burns et al. ..... 60/755
6,205,789 B1 * 3/2001 Patterson et al. ..... 60/754
6,255,000 B1 * 7/2001 O'Connor et al. ..... 428/586
6,383,602 B1 * 5/2002 Fric et al. ..... 428/131
6,408,628 B1 * 6/2002 Pidcock et al. ..... 60/752
6,491,496 B2 * 12/2002 Starkweather ..... 416/97 R
6,546,733 B2 * 4/2003 North et al. ..... 60/772
6,606,861 B2 * 8/2003 Snyder ..... 60/752
6,627,019 B2 * 9/2003 Jarmon et al. ..... 156/89.11
6,769,866 B1 * 8/2004 Kannefass et al. ..... 415/115
6,868,675 B1 * 3/2005 Kuhn et al. ..... 60/772
6,964,170 B2 * 11/2005 Alkabie ..... 60/772
6,981,358 B2 * 1/2006 Bellucci et al. ..... 60/39.17

(Continued)

*Primary Examiner*—William H Rodríguez
(74) *Attorney, Agent, or Firm*—Bachman & LaPointe, P.C.

(57) ABSTRACT

A combustor heat shield panel has interior and exterior surfaces with a number of circuitous non-interconnected cooling gas passageways having inlets on the exterior surface and outlets on the interior surface.

16 Claims, 2 Drawing Sheets

U.S. PATENT DOCUMENTS

| | | | | |
|---|---|---|---|---|
| 7,036,316 | B2 * | 5/2006 | Howell et al. | 60/772 |
| 7,140,185 | B2 * | 11/2006 | Burd | 60/752 |
| 7,146,815 | B2 * | 12/2006 | Burd | 60/752 |
| 7,270,175 | B2 * | 9/2007 | Mayer et al. | 165/47 |
| 2002/0152751 | A1 * | 10/2002 | Mandai et al. | 60/746 |
| 2003/0145604 | A1 * | 8/2003 | Pidcock et al. | 60/796 |
| 2005/0000226 | A1 * | 1/2005 | McCaffrey et al. | 60/796 |
| 2005/0081527 | A1 * | 4/2005 | Howell et al. | 60/748 |
| 2005/0097890 | A1 * | 5/2005 | Ikeda et al. | 60/748 |
| 2006/0005543 | A1 * | 1/2006 | Burd | 60/752 |
| 2006/0053798 | A1 * | 3/2006 | Hadder | 60/772 |
| 2007/0253815 | A1 * | 11/2007 | Kopmels et al. | 416/97 R |

* cited by examiner

GAS TURBINE COMBUSTOR HEAT SHIELD PANEL OR EXHAUST PANEL INCLUDING A COOLING DEVICE

BACKGROUND OF THE INVENTION

This invention relates to combustors, and more particularly to combustor liners and heat shield panels for gas turbine engines.

Gas turbine engine combustors may take several forms. An exemplary class of combustors features an annular combustion chamber having forward/upstream inlets for fuel and air and aft/downstream outlet for directing combustion products to the turbine section of the engine. An exemplary combustor features inboard and outboard walls extending aft from a forward bulkhead in which swirlers are mounted and through which fuel nozzles/injectors are accommodated for the introduction of inlet air and fuel. Exemplary walls are double structured, having an interior heat shield and an exterior shell. The heat shield may be formed in segments, for example, with each wall featuring an array of segments two or three segments longitudinally and 8-12 segments circumferentially. To cool the heat shield segments, air is introduced through apertures in the segments from exterior to interior. The apertures may be angled with respect to longitudinal and circumferential directions to produce film cooling along the interior surface with additional desired dynamic properties. This cooling air may be introduced through a space between the heat shield panel and the shell and, in turn, may be introduced to that space through apertures in the shell. Exemplary heat shield constructions are shown in U.S. Pat. Nos. 5,435,139 and 5,758,503. Exemplary film cooling panel apertures are shown in U.S. Pat. No. 6,606,861.

U.S. Pat. No. 6,255,000 discloses a laminated combustor heat shield construction known by the trademark LAMILLOY. Such construction involves multiple layers each having apertures and pedestals, the pedestals of one layer becoming bonded to the opposite surface of the next layer. The space around and between the pedestals defines a series of plenums vented by the apertures. Nevertheless, there remains room for improvement in heat shield technology.

SUMMARY OF THE INVENTION

One aspect of the invention involves a combustor heat shield panel. A plurality of non interconnected cooling gas passageways have inlets on a panel exterior surface and outlets on the interior surface. The passageways lack line of sight clearance between inlet and outlet along a majority of an area of at least one of the inlet and outlet.

In various implementations, the panel may be formed generally as a frustoconical segment (e.g., optionally including additional mounting features, bosses, reinforcing features and the like). The passageways may lack line of sight clearance between inlet and outlet along an entirety of said area of said at least one of the inlet and outlet. Inlet and outlet end portions of the passageways may have central axes between 30° and 70° of normal to the respective exterior and interior surfaces. The cooling gas passageways may have discharge coefficients of 0.4-0.7. The panel may be in combination with a combustor shell having interior and exterior surfaces and a plurality of cooling gas passageways therebetween, the heat shield panel mounted to the shell so that the heat shield exterior surface and shell interior surface are spaced apart and facing each other adjacent the heat shield cooling gas passageways.

Another aspect of the invention involves a method for manufacturing a cooled gas turbine engine component. An inner layer is formed having a plurality of first apertures. An outer layer is formed having a plurality of second apertures. The inner layer is secured to the outer layer so that the each of the first apertures aligns with an associated one or more of the second apertures to create a non interconnected, non cylindrical passageway through the component.

In various implementations, the securing may comprise diffusion bonding. An intermediate layer may be formed having a plurality of third apertures and the securing may comprise securing the inner layer to the outer layer via the intermediate layer so that the each of the first apertures aligns with an associated one or more of the second apertures and an associated one or more of the third apertures to create the non-cylindrical passageway through the component. The forming of the inner layer may comprise drilling said first apertures and the forming of the outer layer may comprise drilling said second apertures.

Another aspect of the invention involves a gas turbine engine combustor or exhaust component. Means provide a plurality of non interconnected circuitous cooling gas passageways having inlets on an exterior surface and outlets on the interior surface. The passageways may lack line of sight clearance between inlet and outlet along an entirety of said area of said at least one of the inlet and outlet.

Another aspect of the invention involves a gas turbine engine combustor or exhaust component. A plurality of non interconnected cooling gas passageways have inlets on an exterior surface and outlets on the interior surface, the passageways lacking line of sight clearance between inlet and outlet along a majority of an area of at least one of the inlet and outlet. The passageways may lack line of sight clearance between inlet and outlet along an entirety of said area of said at least one of the inlet and outlet.

The details of one or more embodiments of the invention are set forth in the accompanying drawings and the description and claims below.

BRIEF DESCRIPTION OF THE DRAWINGS

Like reference numbers and designations in the various drawings indicate like elements.

DETAILED DESCRIPTION

Figure 1:
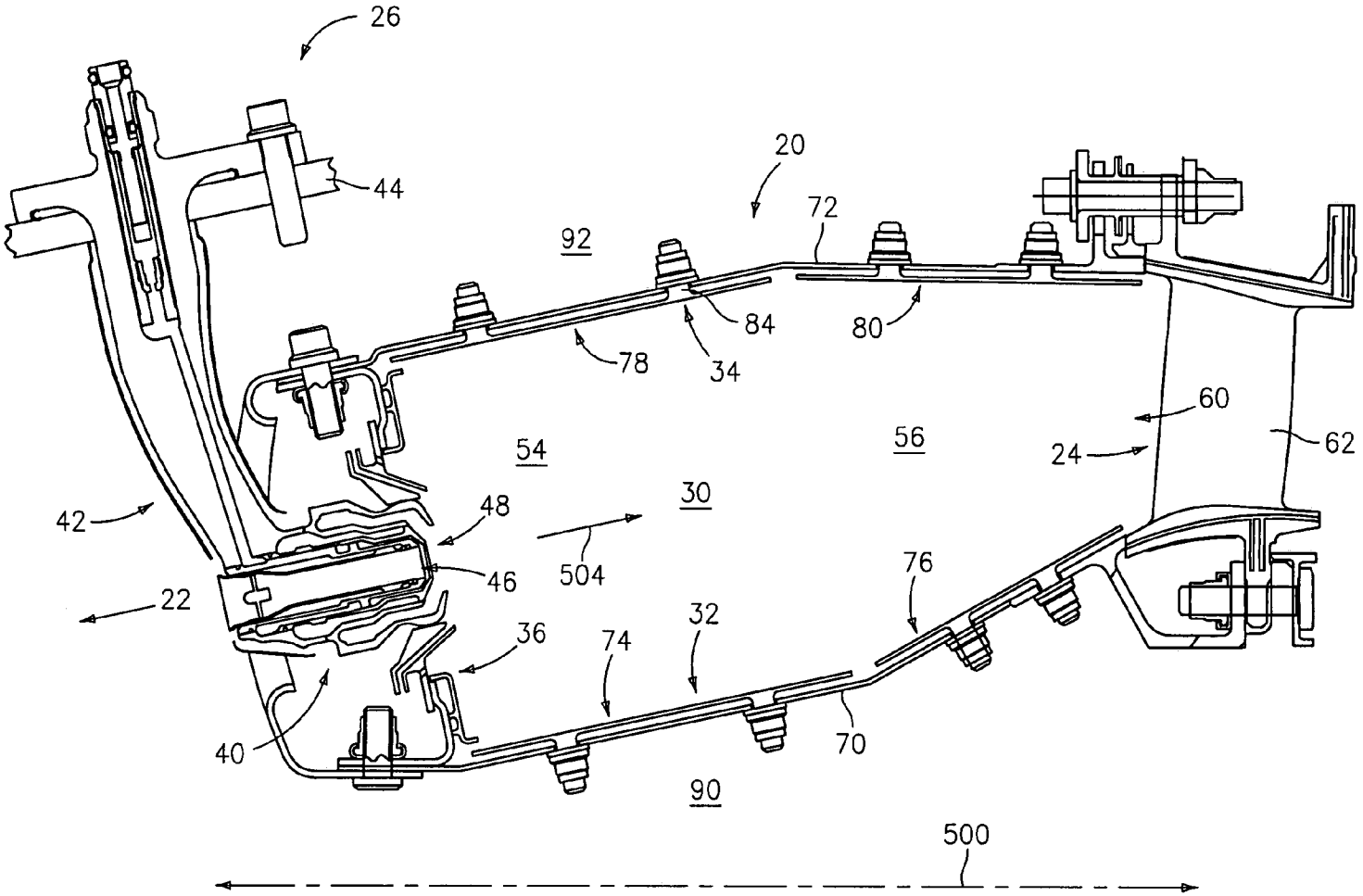
FIG. 1 is a partial longitudinal sectional view of a gas turbine combustor.

FIG. 1 shows an exemplary combustor 20 positioned between compressor and turbine sections 22 and 24 of a gas turbine engine 26 having a central longitudinal axis or centerline 500 (spacing contracted). The exemplary combustor includes an annular combustion chamber 30 bounded by inner (inboard) and outer (outboard) walls 32 and 34 and a forward bulkhead 36 spanning between the walls. The bulkhead carries a circumferential array of swirlers 40 and associated fuel injectors 42. The exemplary fuel injectors extend through the engine case 44 to convey fuel from an external source to the associated injector outlet 46 at the associated swirler 40. The swirler outlet 48 thus serves as an upstream fuel/air inlet to the combustor. A number of sparkplugs (not shown) are positioned with their working ends along an upstream portion 54 of the combustion chamber 30 to initiate combustion of the fuel/air mixture. The combusting mixture is driven downstream within the combustor along a principal flowpath 504 through a downstream portion 56 to a combustor outlet 60 immediately ahead of a turbine fixed vane stage 62.

The exemplary walls 32 and 34 are double structured, having respective outer shells 70 and 72 and inner heat shields. The exemplary heat shields are formed as multiple circumferential arrays (rings) of panels (e.g., inboard fore and aft panels 74 and 76 and outboard fore and aft panels 78 and 80). Exemplary panel and shell material are high temperature or refractory metal superalloys optionally coated with a thermal and/or environmental coating. Alternate materials include ceramics and ceramic matrix composites. Various known or other materials and manufacturing techniques may be utilized. In known fashion or otherwise, the panels may be secured to the associated shells such as by means of threaded studs 84 integrally formed with the panels and supporting major portions of the panels with major portions of their exterior surfaces facing and spaced apart from the interior surface of the associated shell. The exemplary shells and panels are foraminate, passing cooling air from annular chambers 90 and 92 respectively inboard and outboard of the walls 32 and 34 into the combustion chamber 30. The exemplary panels may be configured so that the intact portions of their inboard surfaces are substantially frustoconical. Viewed in longitudinal section, these surfaces appear as straight lines at associated angles to the axis 500.

Figure 2:
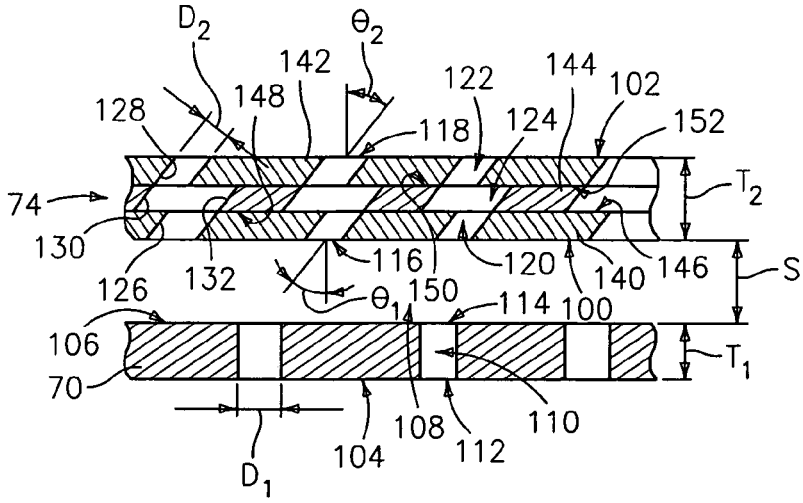
FIG. 2 is a partial longitudinal sectional view of a heat shield panel and shell of the combustor of FIG. 1.

FIG. 2 shows an exemplary construction of one of the heat shield panels. By way of example, the construction is illustrated with respect to the panel 74 although other panels may be so constructed. The exemplary panel 74 is shown having exterior and interior surfaces 100 and 102. The adjacent shell 70 is shown having exterior and interior surfaces 104 and 106. The shell and panel have respective thicknesses $T_1$ and $T_2$ with a separation S between the shell interior surface 106 and panel exterior surface 100 defining a plenum 108. For introducing cooling air to the plenum 108, the shell 70 has a number of passageways 110 extending from exterior inlets 112 to interior outlets 114. The exemplary passageways 110 may be formed by circular cylindrical surfaces of diameter $D_1$ extending normal to the exterior and interior surfaces 104 and 106. In the exemplary embodiment, the passageways 110 may be in one or more regular arrays appropriately configured to provide a desired inlet air distribution to the plenum 108.

The panel 74 has convoluted passageways extending between inlets 116 and outlets 118. The passageways have upstream (inlet) and downstream (outlet) portions 120 and 122 extending respectively from the inlet and to the outlet. In the exemplary embodiment, the upstream and downstream portions are out of alignment with each other, connected by a transversely spanning (e.g., at least partially transverse to the panel surfaces) intermediate portion 124. The exemplary upstream and downstream portions 120 and 122 are formed respectively by surfaces 126 and 128 characterized as angled lengths of a right circular cylinder of diameter $D_2$ angled at respective angles $\theta_1$ and $\theta_2$ off normal to the associated surface 100 and 102. The intermediate portions 124 are elongate in a direction of offset between the upstream and downstream portions. The exemplary intermediate portions are bounded by a surface characterized as an off-normal length of a right obround prism extending between first and second ends 130 and 132. The exemplary obround shares the common end diameter $D_2$ so as to provide smooth transitions with the upstream and downstream portions. Intermediate portions having curvature, circuitiousness, splitting/rejoining, or other planform geometry are among variations.

Other geometries may, however, be possible including the possibility of differently-sized and/or angled and/or shaped upstream and downstream portions. The upstream and downstream portions can be at various orientations with respect to one another. The passageways may have a more varying cross-sectional area or shape. For example to provide a desired discharge coefficient or performance, the upstream portion's cross-sectional area may be smaller than the downstream portion's. The intermediate portion may provide a transitional cross-sectional area or shape. The offset provided by the intermediate portion 124 may be effective to partially occlude the panel inlet relative to the panel outlet. For example, along a portion of one or both of the inlet or outlet there may be no line of sight clearance between the two. An exemplary fraction for such occlusion is a majority of the area(s) of the inlet and/or outlet. In various implementations, the intermediate portion need not extend parallel to the surfaces of the associated panel. Particularly if cast or forged in place (discussed further below), the intermediate portion may readily be configured as non-parallel to the panel surfaces.

In an exemplary method of construction, the panel 74 is formed of three initially separate layers: an exterior layer 140; an interior layer 142; and an intermediate layer 144. The upstream passageway portions 120 may be drilled in the exterior layer and the downstream passageway portions 122 may be drilled in the interior layer. The intermediate passageway portions may be drilled/milled in the intermediate layer. The layers may be sandwiched with the exterior layer interior surface 146 against the intermediate layer exterior surface 148 and the intermediate layer interior surface 150 against the interior layer exterior surface 152 and bonded (e.g., by diffusion bonding).

The circuitous passageways through the panels provide a lower discharge coefficient than a straight passageway of otherwise similar section (i.e., a single hole of diameter $D_2$). Exemplary discharge coefficients are 0.4-0.7. The circuitous passageways also have relatively enhanced surface areas for heat transfer. The higher discharge coefficient may permit changes in the passageway size and/or density relative to straight passageways while maintaining other properties. For example, for a given pressure drop across the panel, and with a given passageway cross-section, there may be a higher density of passageways at equivalent cooling flows or cooling levels. This higher density along with the enhanced surface area per passageway can provide enhanced heat transfer (in terms of heat transfer per planform panel area and, more substantially, in terms of heat transfer per mass flow of air through the panel). The convoluted air flow within the passage also promotes flow features, patterns and turbulence that enable higher convective heat transfer within the passages.

In an exemplary embodiment, exemplary panel passageway diameter $D_2$ is 0.010-0.035 inch and exemplary panel passageway density is 50-150 holes per square inch. Exemplary angles $\theta_1$ and $\theta_2$ are 30-75°, more narrowly, 45°-70°. The angles may be chosen to provide desired film cooling effects along the panel interior and exterior surfaces. Exemplary shell passageway diameter $D_1$ is 0.010-0.035 inch with a density less than that of the panel, generally 20-50 holes per square inch.

Figure 3:
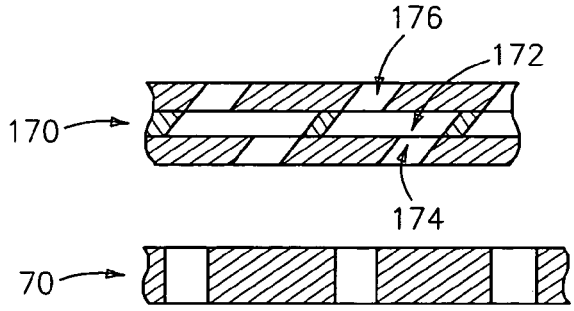
FIG. 3 is a partial longitudinal sectional view of an alternate heat shield panel.

FIG. 3 shows an alternate panel 170 constructs similarly to the panel of FIG. 2 but wherein the passageway intermediate portions 172 are relatively longer, more greatly offsetting the upstream and downstream portions 174 and 176. In the illustrated embodiment, the offset is sufficient that there is no line of sight path between passageway inlet and outlet.

Figure 4:
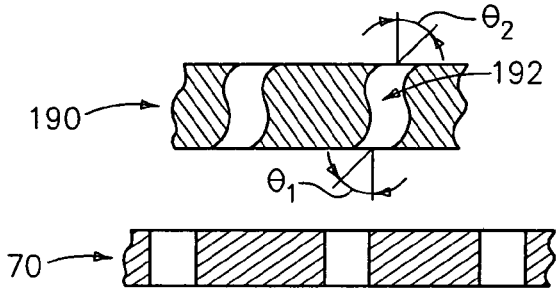
FIG. 4 is a partial longitudinal sectional view of another alternate heat shield panel.
Figure 5:
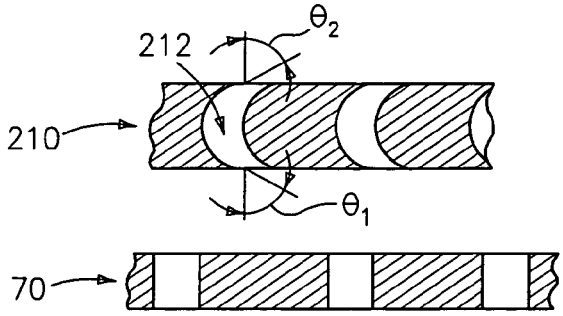
FIG. 5 is a partial longitudinal sectional view of another alternate heat shield panel.

FIG. 4 shows a panel 190 having smoothly circuitous passageways 192 (e.g., somewhat S-shaped in longitudinal section). The exemplary panel 190 may be formed using sacrificial cores to form the passageways (e.g., in a liquid metal casting or a powdered metal forging process). The cores may be chemically removed after the casting or forging. However such casting or forging processes may also be used to manufacture non-smooth passageways. For this embodiment, panel passageway diameter, density, and inlet/outlet orientation may be similar to that of FIG. 2 and have similar variations as discussed above FIG. 5 shows a panel 210 which may be otherwise similar to the panel 190 except that the passageways 212 are C-shaped in section. Exemplary passageway dimensions and distribution may be similar. However, advantageously, at least the discharge angle $\theta_2$ may be greater (e.g., 50-70°, more narrowly about 60°) so that the discharged air is at a shallower angle closer to the interior surface to improve cooling efficiency.

In a single-wall combustor liner or heat shield construction, hole densities would tend to be lower than double wall constructions because the flow resistance provided by the shell is no longer present. Gas turbine engines often feature analogous structure to combustors. Whereas the combustor shell is typically structural, exhaust systems often have analogous nonstructural components commonly known as baffle and throttle segments and may have liners analogous to the combustor heat shields.

One or more embodiments of the present invention have been described. Nevertheless, it will be understood that various modifications may be made without departing from the spirit and scope of the invention. For example, when applied as a retrofit for an existing combustor, details of the existing combustor will influence details of the particular implementation. Accordingly, other embodiments are within the scope of the following claims.

What is claimed is:

1. A metal laminate combustor heat shield panel comprising:
- an interior surface;
- an exterior surface; and
- a plurality of cooling gas passageways non-interconnected with each other and having inlets on the exterior surface and outlets on the interior surface, the passageways lacking line of sight clearance between inlet and outlet along a majority of an area of at least one of the inlet and outlet, wherein the metal laminate is formed generally as a frustoconical segment and comprises:
  - a first layer forming the exterior surface;
  - a second layer forming the interior surface; and
  - an intermediate layer cooperating with the first layer and second layer to form turns in the passageways.

2. The panel of claim 1 wherein the passageways lack line of sight clearance between inlet and outlet along an entirety of said area of said at least one of the inlet and outlet.

3. The panel of claim 1 wherein inlet and outlet end portions of the passageways have central axes between 30° and 70° of normal to the respective exterior and interior surfaces.

4. The panel of claim 1 wherein the cooling gas passageways have discharge coefficients of 0.4-0.7.

5. The panel of claim 1 in combination with a combustor shell having interior and exterior surfaces and a plurality of cooling gas passageways therebetween, the heat shield panel mounted to the shell so that the heat shield exterior surface and shell interior surface are spaced apart and facing each other adjacent the heat shield cooling gas passageways.

6. The component of claim 1 wherein the first layer and the second layer are diffusion bonded to the intermediate layer.

7. A metal laminate gas turbine engine combustor or exhaust component comprising:
- an interior surface;
- an exterior surface; and
- a plurality of cooling gas passageways non-interconnected with each other and having inlets on the exterior surface and outlets on the interior surface, the passageways lacking line of sight clearance between inlet and outlet along a majority of an area of at least one of the inlet and outlet, wherein the metal laminate is formed as a frustoconical segment and comprises:
  - a first layer forming the exterior surface;
  - a second layer forming the interior surface; and
  - an intermediate layer cooperating with the first layer and second layer to form turns in the passageways.

8. The component of claim 7 wherein the passageways lack line of sight clearance between inlet and outlet along an entirety of said area of said at least one of the inlet and outlet.

9. The component of claim 7 wherein the turns are greater than ninety degrees.

10. The component of claim 7 wherein the laminate has a single said intermediate layer.

11. The component of claim 7 wherein the first layer and the second layer are diffusion bonded to the intermediate layer.

12. A combination comprising:
- a metal laminate combustor heat shield panel comprising:
  - an interior surface;
  - an exterior surface; and
  - a plurality of cooling gas passageways non-interconnected with each other and having inlets on the exterior surface and outlets on the interior surface, the passageways lacking line of sight clearance between inlet and outlet along a majority of an area of at least one of the inlet and outlet, wherein the metal laminate comprises:
    - a first layer forming the exterior surface;
    - a second layer forming the interior surface; and
    - an intermediate layer cooperating with the first layer and second layer to form turns in the passageways; and
  - a combustor shell having:
    - an interior surface;
    - an exterior surface; and
    - a plurality of cooling gas passageways between the interior surface and exterior surface, the heat shield panel mounted to the shell so that the heat shield exterior surface and shell interior surface are spaced apart and facing each other adjacent the heat shield cooling gas passageways.

13. The component of claim 12 wherein the first layer and the second layer are diffusion bonded to the intermediate layer.

14. A metal laminate gas turbine engine combustor or exhaust component comprising:
- an frustoconical interior surface;
- an exterior surface; and
- a plurality of cooling gas passageways non-interconnected with each other and having inlets on the exterior surface and outlets on the interior surface, the passageways lacking line of sight clearance between inlet and outlet along a majority of an area of at least one of the inlet and outlet, wherein the metal laminate comprises:

a first layer forming the exterior surface;

a second layer forming the interior surface; and an intermediate layer cooperating with the first layer and second layer to form turns in the passageways.

15. The component of claim 14 wherein the first layer and the second layer are diffusion bonded to the intermediate layer.

16. The component of claim 14 wherein the laminate has a single said intermediate layer.

* * * * *